US010830079B2

(12) United States Patent
Coetard et al.

(10) Patent No.: US 10,830,079 B2
(45) Date of Patent: Nov. 10, 2020

(54) DETACHABLE ANTI-WEAR CAP FOR RECTIFIER SECTOR

(71) Applicant: SAFRAN AIRCRAFT ENGINES, Paris (FR)

(72) Inventors: Jean-Charles Marcel Bernard Coetard, Moissy Cramayel (FR); Josserand Jacques Andre Bassery, Moissy Cramayel (FR); Raphael Jean Philippe Dupeyre, Moissy Cramayel (FR); Etienne Leon Francois, Moissy Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 64 days.

(21) Appl. No.: 16/174,531

(22) Filed: Oct. 30, 2018

(65) Prior Publication Data

US 2019/0128133 A1 May 2, 2019

(30) Foreign Application Priority Data

Oct. 31, 2017 (FR) ..... 17 60288

(51) Int. Cl.
*F01D 11/00* (2006.01)
*F04D 29/08* (2006.01)
(Continued)

(52) U.S. Cl.
CPC ..... *F01D 11/008* (2013.01); *F01D 5/225* (2013.01); *F01D 5/28* (2013.01); *F01D 9/04* (2013.01);
(Continued)

(58) Field of Classification Search
CPC . F01D 5/225; F01D 5/28; F01D 9/047; F01D 9/04; F01D 11/008; F01D 11/00;
(Continued)

(56) References Cited

U.S. PATENT DOCUMENTS 9,322,286 B2 * 4/2016 Digard Brou De Cuissart ..... F01D 9/041
2008/0145207 A1 * 6/2008 Mohr ..... F01D 5/225 415/173.1
(Continued)

FOREIGN PATENT DOCUMENTS

EP 2 071 129 A1 6/2009
FR 2 928 962 A1 9/2009
(Continued)

OTHER PUBLICATIONS

French Preliminary Search Report dated Jul. 12, 2018 in Patent Application No. FR 1760288 (with English translation of categories of cited documents), citing documents AO-AR therein, 4 pages.

*Primary Examiner* — Nathaniel E Wiehe
*Assistant Examiner* — Eric A Lange
(74) *Attorney, Agent, or Firm* — Oblon, McClelland, Maier & Neustadt, L.L.P.

(57) ABSTRACT

An assembly including a sector of fixed blades for turbomachine distributor including at one circumferential end a protuberance and at another circumferential end a contact surface, such that the protuberance of a sector arrives opposite the contact surface of another adjacent sector, a detachable cap including a surface with anti-wear material, configured to be engaged detachably on the protuberance of the sector, such that the anti-wear material is in contact with the contact surface of the other sector.

11 Claims, 4 Drawing Sheets

(51) Int. Cl.

| | |
|---|---|
| ***F01D 5/28*** | (2006.01) |
| ***F01D 9/04*** | (2006.01) |
| ***F01D 5/22*** | (2006.01) |
| ***F01D 25/24*** | (2006.01) |

(52) U.S. Cl.
CPC ..... *F01D 9/047* (2013.01); *F01D 11/00* (2013.01); *F01D 25/246* (2013.01); *F04D 29/083* (2013.01); *F05B 2240/57* (2013.01); *F05B 2240/80* (2013.01); *F05B 2280/103* (2013.01); *F05D 2230/64* (2013.01)

(58) Field of Classification Search
CPC .. F01D 25/246; F04D 29/083; F05D 2230/64; F05B 2240/57; F05B 2240/80; F05B 2280/103
See application file for complete search history.

(56) References Cited

U.S. PATENT DOCUMENTS

| | | | |
|---|---|---|---|
| 2009/0155061 | A1 | 6/2009 | Girard et al. |
| 2011/0044798 | A1 | 2/2011 | Digard Brou De Cuissart et al. |

FOREIGN PATENT DOCUMENTS

| | | | |
|---|---|---|---|
| FR | 2 930 592 | A1 | 10/2009 |
| FR | 2 993 002 | A1 | 1/2014 |

* cited by examiner

DETACHABLE ANTI-WEAR CAP FOR RECTIFIER SECTOR

GENERAL TECHNICAL FIELD

The invention relates to turbomachine distributors, and a turbomachine comprising such distributors.

The invention relates to the placing of anti-wear material on sectors of fixed distributor blades, especially turbine blades.

PRIOR ART

In a turbomachine, the turbine recovers some of the energy from the combustion of gases to operate the fan, the compressor and the accessories. One of the pieces constituting the turbomachine is the distributor.

Figure 1:
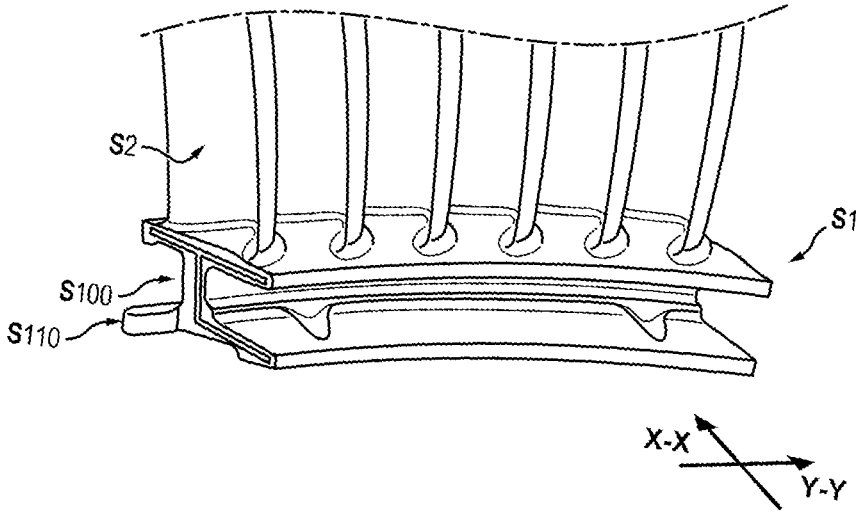
FIG. 1 Prior Art
Figure 2:
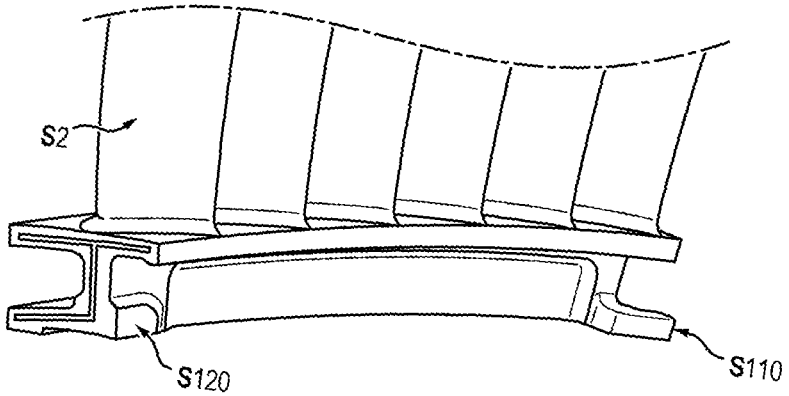
FIG. 2 Prior Art

FIG. 1 is a representation of a sector S1 of distributor from the prior art, in an upstream view, and FIG. 2 a representation in a downstream view, according to the direction of flow of the gaseous fluid in the distributor. Each sector comprises an external platform (not shown), an internal platform S100, and one or more impellers S2 whereof the radial ends are fixed respectively to the internal platform S100 and to the external platform. The external platforms of the sectors are fixed to a housing of the turbomachine, which fixes the configuration of the distributor. The different loads of the turbine result in relative shifts of the adjacent sectors of the distributor, according to the longitudinal axis X-X. These shifts, more or less substantial, cause wear to the impellers of the distributor. To limit the relative shift of the adjacent sectors of the distributor according to the longitudinal axis, a protuberance S110 is provided in the region of an end of each internal platform S100. This protuberance S110 extends according to the longitudinal axis X-X and according to the transversal axis Y-Y. This protuberance S110 is in contact with a contact surface S120, arranged in the region of another end of an internal platform of the adjacent piece. An alloy of cobalt and chrome is a material adapted to the loads at play.

For this, a known process consists of depositing, after manufacture of the blade, anti-wear material in the region of some friction zones by brazing or filling, in the region of the protuberance and in the region of the contact surface. But this process, called "stelliting", from the commercial name of the anti-wear material generally employed, is complicated and causes cracking, brittle zones at the interface between the two materials and missing material.

Also, these zones which wear, must be repaired regularly. Typically, the rest of the anti-wear material is removed and a new layer is laid.

Document FR2993002 describes another type of fastening between the sectors, with especially a pin lodged in a slot and wedged in between two opposite surfaces, which acts as anti-wear material.

Another known process consists of placing an insert in the blade which, after heating, forms an integral. But this causes difficulties at the interfacing, especially due to the bi-material character of the blade.

There is consequently a need for improving to simplify the "stelliting" of distributor segment.

PRESENTATION OF THE INVENTION

The invention proposes an assembly comprising:

a sector of fixed blades for turbomachine distributor comprising at one circumferential end a protuberance and at another circumferential end a contact surface, such that the protuberance of a sector arrives opposite the contact surface of another adjacent sector, a detachable cap comprising a surface with anti-wear material, configured to be engaged detachably on the protuberance of the sector, such that the anti-wear material is in contact with the contact surface of the other sector.

The invention can comprise the following characteristics, taken singly or in combination:

the sector comprises an internal platform comprising an upper plate, on which are fixed the fixed blades and a lower plate, connected to the upper plate by a spacer, the protuberance and the contact surface are at the ends of the upper plate or of the lower plate, the anti-wear material is in the form of a wafer which defines the surface, the cap is made entirely of anti-wear material, the anti-wear material comprises cobalt or an alloy of cobalt, the cap is in the form of a block comprising a blind recess forming a cavity suitable for receiving the protuberance, such that the protuberance is enveloped by the cap, the contact surface comprises anti-wear material.

The invention also relates to a portion of turbomachine distributor comprising at least two assemblies such as described earlier, defining two sectors, wherein the protuberance of one of the two sectors comprises the detachable cap put in place, the latter being engaged with the contact surface (120) of the other sector.

Finally, the invention proposes a distributor comprising a plurality of portions such as described earlier, the portions being placed end to end.

PRESENTATION OF FIGURES

Figure 3:
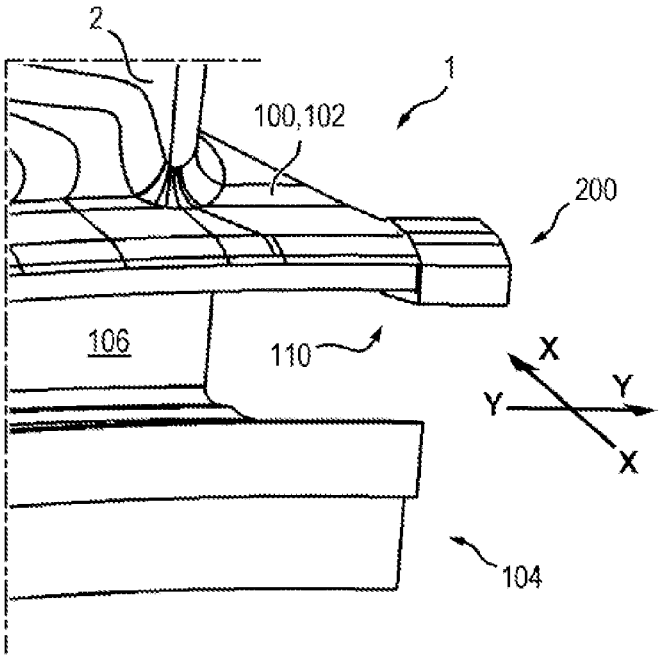
Figure 4:
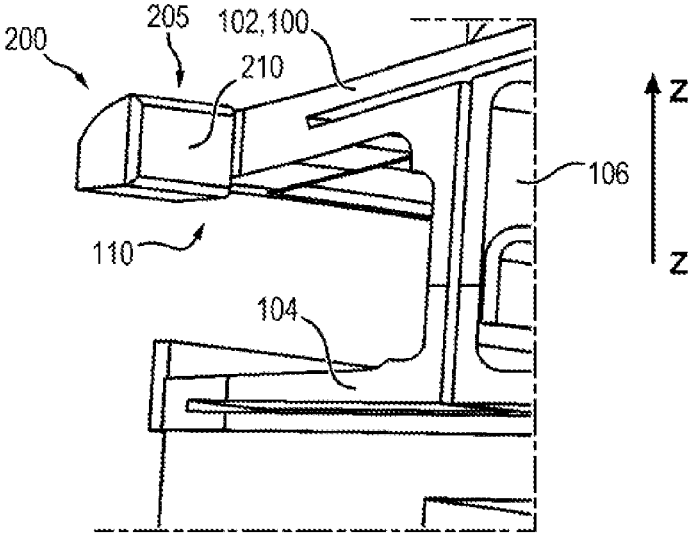
Figure 5:
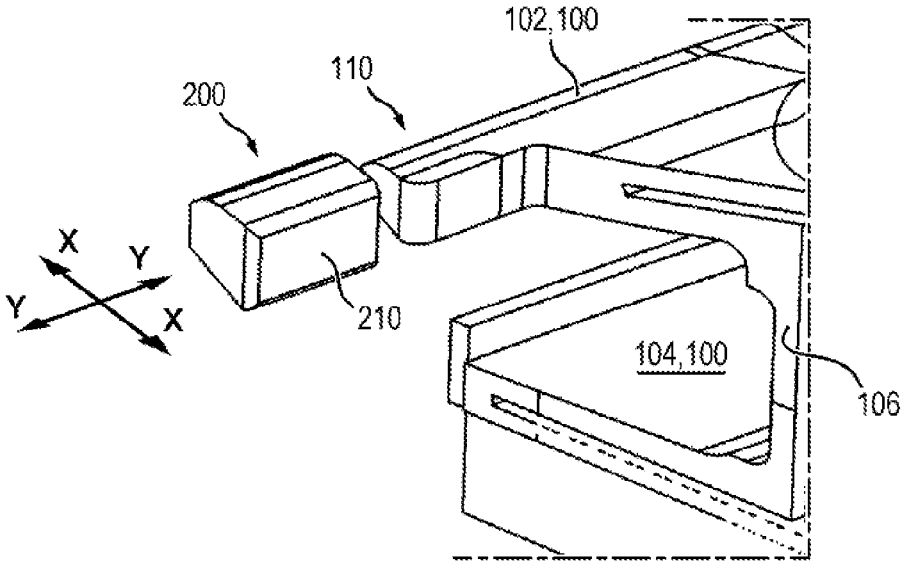
Figure 6:
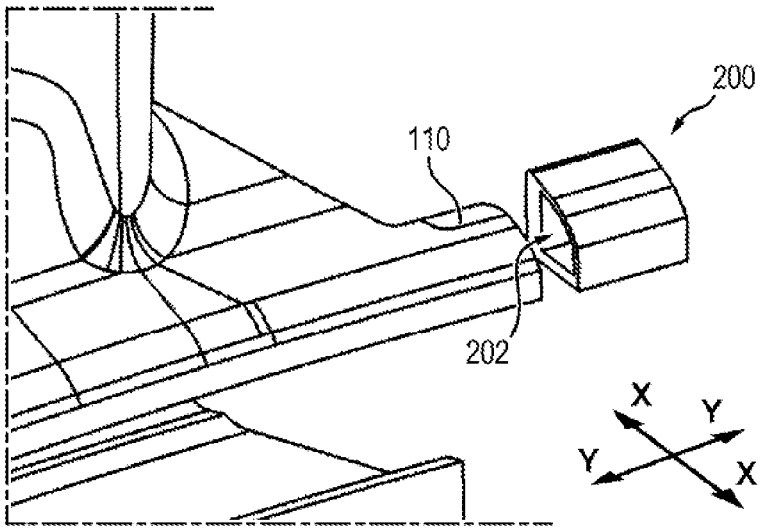
Figure 7:
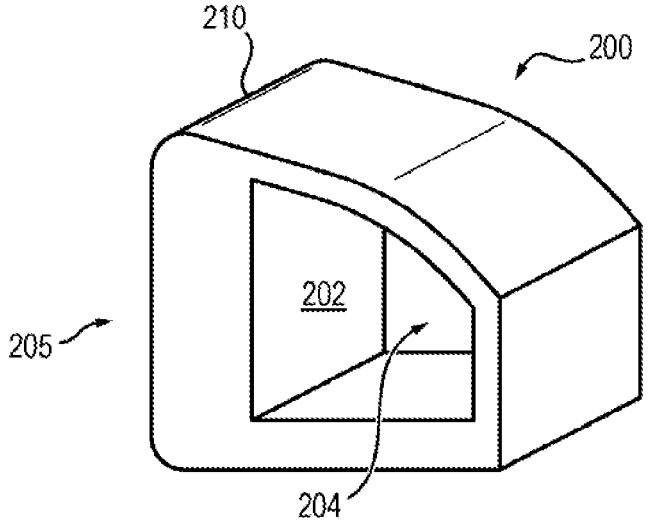
Figure 8:
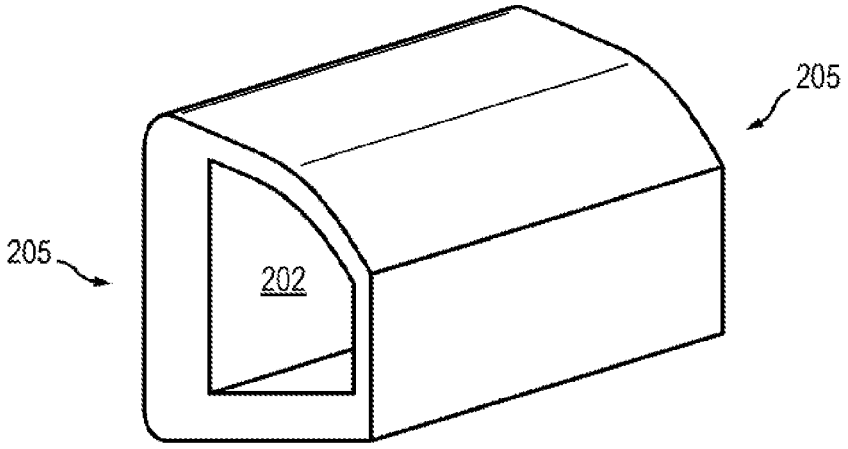

Other characteristics, aims and advantages of the invention will emerge from the following description which is purely illustrative and non-limiting and which must be considered with respect to the appended drawings, in which:

FIGS. 1 and 2 illustrate a sector of distributor such as currently exists, FIGS. 3 and 4 illustrate different views of a cap according to a particular mode of the invention, mounted on the sector, FIGS. 5 and 6 illustrate different views of a cap according to a particular mode of the invention, during mounting on a sector, FIGS. 7 and 8 illustrate different views of a cap according to a particular mode of the invention.

DETAILED DESCRIPTION

The detailed description will be given on a sector of distributor, for example in the region of the turbine stages.

A distributor 1 is made by assembling several sections 1 placed end to end circumferentially around an axis X-X of the turbomachine.

Each section comprises an internal platform 100 (which generally refers to abradable material and creates sealing with the upstream and/or downstream mobile wheel), an external platform (not shown), attached to a housing, and a plurality of blades 2 whereof the radial ends are attached to the two platforms respectively. The blade 2 is the part which receives the flow of air emanating from an air stream (primary stream for a dual-flow turbomachine turbine for example). When installed, the blade 2 extends radially towards the outside relative to the longitudinal axis X-X of the turbomachine. The direction of extension of the impeller 110 substantially defines a direction Z-Z. In one embodiment the segment 1 comprises six blades.

The internal platform therefore exhibits a form of annular segment type.

The surfaces of the platforms radially delimit an aerodynamic flow channel, called a stream.

As illustrated in FIGS. 3 to 6, the internal platform 100 comprises at one circumferential end a protuberance 110 which extends according to the direction Y-Y, that is, according to the circumference. This protuberance 110 has the form of a slightly elongated projection.

Defined at the other circumferential end of the internal platform 100 is a contact surface 120 (see reference S120 in FIGS. 1 and 2). When two sectors 1 are put side by side, the protuberance 110 is axially opposite the contact surface 120: this means that the protuberance 110 and the contact surface 120 are arranged opposite each other according to the longitudinal direction X-X.

The protuberance 110 is typically formed in the extension of the internal platform 100 according to the direction Y-Y. In the same way, the contact surface 120 is typically formed by recessing in the internal platform 100 to create the necessary axial offset.

The internal platform 100 can comprise an upper plate 102, separated from a lower plate 104 by a spacer 106. The upper plate 102 carries the blades 2 and the lower plate 104 serves for example to carry the abradable material to ensure tightness with upstream and/or downstream wheels.

A cap 200 is provided to better generate friction. It can be fitted on (FIGS. 3 and 4) or removed from (FIGS. 5 and 6, illustrated only in FIGS. 7 and 8) the protuberance 110. The cap 200 has a surface 205 configured to be in contact with the contact surface 120 when it is installed on the protuberance.

The surface 205 is made of anti-wear material and rubs the contact surface 120 of the platform 100.

The cap 200 therefore serves as sheath for the protuberance and installs anti-wear material (called "stellite") on the internal platform rapidly and simply.

The cap 200 therefore envelops the whole end of the protuberance, ensuring good hold. Its sole degree of liberty is according to the axis Y-Y, where it comes to stop against the adjacent segment.

In one embodiment, the anti-wear material 210 is in the form of an applied wafer which defines the surface 205. The worn wafer can simply be exchanged for a new one.

In another embodiment, the whole cap 200 is made of anti-wear material. This embodiment has the advantage of also offering better resistance to wear caused by tangential shifts according to the direction Y-Y'.

The cap 200 is in the form of a block with a blind recess 202 having a base 204. The recess 202 creates a cavity inside which the protuberance 110 is housed.

The recess 202 has a form complementary to the protuberance 110 so it can the least possible play between the two. Also, as the protuberance is generally not circular in cross-section, neither is the recess 202 and the rotation of the cap 200 is naturally prevented.

Because of the cap 200, there is no need for the contact surface 120 of the segment to comprise an anti-wear material, therefore simplifying "stelliting". But since stellite is a very hard material, it is preferable to have a contact surface 120 likewise made of anti-wear material, generally the same. The contact surface 120 is preferably covered by a cap in turn.

The placing of the cap 200 is done by insertion in translation according to the direction Y-Y, which is rapid and minimally labour-intensive. Simple nesting is preferred, without adhesive or other fastening means and just one operator is required.

Once the material 210 worn, only the cap 200 or the wafer is replaced.

Also, such a cap does not dictate reviewing the structure of the segment 1. In fact, the thickness of stellite deposited by brazing (for example) is replaced by the thickness of the cap 200 and of the surface 205 of anti-wear material.

Cobalt or an alloy of cobalt is used as anti-wear material, for example.

FIGS. 7 and 8 illustrate dimensions, given by way of illustration. For example, the thickness of the contact surface is at least one millimeter to prevent the appearance of cracking on the metal.

The length according to the direction Y-Y has to be sufficient to ensure retention, such as five millimeters for example.

The invention claimed is:

1. An assembly comprising:
   - a sector of fixed blades for a turbomachine distributor comprising a protuberance at one circumferential end and a contact surface at another circumferential end a, such that the protuberance of a sector arrives opposite the contact surface of another adjacent sector, and
   - a detachable cap comprising a surface with antiwear material, configured to be engaged detachably on the protuberance of the sector such that the cap envelopes the protuberance and such that the antiwear material is in contact with the contact surface of the other sector.

2. The assembly according to claim 1, wherein the sector comprises an internal platform comprising an upper plate, on which are fixed the fixed blades and a lower plate, connected to the upper plate by a spacer.

3. The assembly according to claim 2, wherein the protuberance and the contact surface are at the circumferential ends of the upper plate or of the lower plate.

4. The assembly according to claim 1, wherein the anti-wear material is in a form of a wafer which defines the surface.

5. The assembly according to claim 1, wherein the cap is made entirely of anti-wear material.

6. The assembly according to claim 1, wherein the anti-wear material comprises cobalt or an alloy of cobalt.

7. The assembly according to claim 1, wherein the cap is in a form of a block comprising a blind recess forming a cavity suitable for receiving the protuberance, such that the protuberance is enveloped by the cap.

8. The assembly according to claim 1, wherein the contact surface comprises anti-wear material.

9. A portion of turbomachine distributor comprising at least two assemblies according to claim 1, defining first and second sectors, wherein the protuberance of the first sector comprises the detachable cap put in place, the detachable cap being engaged with the contact surface of the second sector.

10. A distributor comprising a plurality of portions according to claim 9, the portions being placed end to end.

11. An assembly comprising:
   - a sector of fixed blades for a turbomachine distributor comprising a protuberance at one circumferential end and a contact surface at another circumferential end, such that the protuberance of a sector arrives opposite the contact surface of another adjacent sector, and
   - a detachable cap comprising a surface with anti-wear material, configured to be engaged detachably on the protuberance of the sector, such that the anti-wear material is in contact with the contact surface of the other sector, wherein the cap is in a form of a block comprising a blind recess forming a cavity suitable for receiving the protuberance, such that the protuberance is enveloped by the cap.

* * * * *